US006514601B1

(12) United States Patent
Sadasivan et al.

(10) Patent No.: US 6,514,601 B1
(45) **Date of Patent: *Feb. 4, 2003**

(54) INK JET RECORDING ELEMENT

(75) Inventors: Sridhar Sadasivan, Rochester, NY (US); Lloyd A. Lobo, Webster, NY (US); John M. Baier, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 86 days.

This patent is subject to a terminal disclaimer.

(21) Appl. No.: 09/850,026

(22) Filed: May 7, 2001

(51) Int. Cl.[7] ..... B41M 5/00
(52) U.S. Cl. ..... 428/195
(58) Field of Search ..... 428/195

(56) References Cited

U.S. PATENT DOCUMENTS

| | | | | |
|---|---|---|---|---|
| 5,919,559 | A | | 7/1999 | Nakano et al. |
| 5,932,335 | A | | 8/1999 | Keller et al. |
| 5,932,355 | A | * | 8/1999 | Iqbal et al. ..... 428/195 |

* cited by examiner

*Primary Examiner*—Pamela R. Schwartz
(74) *Attorney, Agent, or Firm*—Harold E. Cole

(57) ABSTRACT

An ink jet recording element comprising a support having thereon a porous image-receiving layer comprising at least about 90% by weight of particles and less than about 10% by weight of a binder, the image-receiving layer also containing a nonionic surfactant having an HLB number of less than about 10 in an amount to substantially prevent foaming of the coating composition which is used to coat the support with the image-receiving layer.

17 Claims, No Drawings

INK JET RECORDING ELEMENT

CROSS REFERENCE TO RELATED APPLICATION

Reference is made to commonly assigned, co-pending U.S. patent application Ser. No. 09/850,027 by Sadasivan et al., filed of even date herewith entitled "Ink Jet Printing Method", now U.S. Pat. No. 6,419,356.

FIELD OF THE INVENTION

This invention relates to an ink jet recording element, more particularly to a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

U.S. Pat. No. 5,932,355 relates to an ink-jet recording sheet wherein the ink-receptive composition contains a non-ionic silicone surfactant, from about 14 to about 93% by weight of a polymer and a small amount of particulates such that the coating is transparent. However, there is a problem with this element in that it is not porous, so that it has a poor dry time.

U.S. Pat. No. 5,919,559 relates to an ink jet recording sheet comprising an ink absorbing layer containing a predominant amount of water soluble resin or water dispersible resin and an nonionic surfactant having an HLB number of 11 or more. However, there is a problem with this element in that it is not porous, so that it will have a poor dry time.

It is an object of this invention to provide an ink jet recording element that is porous. It is another object of the invention to provide an ink jet recording element that has a fast dry time and good image quality.

SUMMARY OF THE INVENTION

These and other objects are achieved in accordance with the invention which comprise an ink jet recording element comprising a support having thereon a porous image-receiving layer comprising at least about 90% by weight of particles and less than about 10% by weight of a binder, the image-receiving layer also containing a nonionic surfactant having an HLLB number of less than about 10 in an amount to substantially prevent foaming of the coating composition which is used to coat the support with the image-receiving layer By use of the invention, a porous ink jet recording element is obtained which has a fast dry time and good image quality.

DETAILED DESCRIPTION OF THE INVENTION

The presence of a binder in an image-receiving layer coating solution increases its propensity to foam. The coating solution typically requires a large amount of agitation to minimize the concentration gradients of the ingredients and thereby reduce variability. This agitation, however, typically leads to entrainment of air, which leads to the formation of excessive foam.

In accordance with the invention, certain non-ionic surfactants have been found to be antifoaming agents. In addition, these materials do not themselves foam at low concentrations.

As noted above, the non-ionic surfactants which are used in this invention have an HLB number less than about 10. The HLB number of a surfactant is used to specify the nature of an oil/water dispersion that is formed in the presence of that surfactant. If the HLB number is less than 7, the dispersed (or drop) phase will be water. If the HLB number is above 12, the dispersed phase will be oil.

It has been found that the HLB number can also be used to predict the ability of a nonionic surfactant to eliminate foam in a coating solution. If a surfactant has an HLB number of 10 or greater, the surfactant may enhance the stability of the foam instead of eliminating it.

The HLB number of surfactants can be measured or calculated. There are several methods of measuring HLB, some of which are listed in "Nonionic Surfactants", Ed. M. Schick, "Surfactant Science Series", Vol. 1, Marcel Deker Inc., New York, 1967.

There are several kinds of nonionic surfactants that can be used in the present invention. There can be used, for example, ethoxylated alcohols having the formula R—O $(CH_2CH_2O)_nH$ where R can be alkyl, aryl or aralkyl having from about 2 to about 30 carbon atoms and n can vary from about 2 to about 20. The HLB number of an ethoxylated alcohol is related to the ratio of the number of ethylene oxide groups to the number of carbon atoms in the R group. Preferred ethoxylated alcohols useful in the invention include those where all or some of the hydrogen atoms in the R group are substituted by fluorine atoms.

Another class of nonionic surfactants useful in the invention is the block copolymers of ethylene oxide and propylene oxide. Examples of these are Pluronics® (poloxamers) which are triblock copolymers and Tetronics® (poloxamines), which are tetrafunctional block copolymers derived from the sequential addition of propylene oxide and ethylene oxide to ethylenediamine. The ratio of the amount of propylene oxide to ethylene oxide is directly related to the HLB number of the surfactant.

Another class of nonionic surfactants useful in the invention is alkoxylated poly(dimethylsiloxanes) (PDMS) or polyalkylene-modified PDMS materials, including those containing ethylene oxide as well as ethylene oxide and propylene oxide and having an HLB number as described above.

Another class of nonionic surfactants useful in the invention is based on derivatives of mono and disaccharides, including sorbitol esters such as Spans®, and alkyl glucosides and hydrophobic sucrose esters such as sucrose distearate.

Commercial examples of the above surfactants useful in the invention include:

S-1 Silwet® L7220 (Witco Corp.)

S-2 Silwet® L7210 (Witco Corp.)

S-3 Silwet® L7602 (Witco Corp.)

S-4 Pluronic® L61 (BASF Corp.)

S-5 Tetronic® 90R4 (BASF Corp.)

S-6 Tetronic® 701 (BASF Corp.)

S-7 Tetronic® 150R1 (BASF Corp.)

S-8 Fluorad® FC171 (3M Corp.)

S-9 Brij® 30 (ICI Chemicals)

S-10 Brij® 93 (ICI Chemicals)

The surfactants used in the present invention are typically used in relatively small amounts. Based on their HLB numbers, these surfactants have limited solubility in coating solutions. These surfactants have a cloud point, which is the highest temperature at which the surfactant is soluble in water. Coating operations typically take place between about 25 and 30° C. Therefore, these surfactants are usually used at levels below their solubility limit at the operating temperature. In general, the surfactants may be used in an amount of at least about 0.05% by weight of the coating solution, preferably from about 0.05% to about 1.0% by weight.

Examples of particles useful in the invention include alumina, boehmite, clay, calcium carbonate, titanium dioxide, calcined clay, aluminosilicates, silica, barium sulfate, or polymeric beads. The particles may be porous or nonporous. In a preferred embodiment of the invention, the particles are inorganic such as alumina, silica, fumed alumina or fumed silica. Such particles are preferred for ink jet recording elements because they possess positively charged surfaces, which are capable of binding anionic ink jet printing dyes, rendering printed images resistant to dye migration due to water and high humidity conditions.

As noted above, the porous image-receiving layer comprises at least about 90% by weight of particles. This amount of particles will insure that the layer is porous, i.e., have interconnecting voids so that the solvent in the ink can travel through the layer to a support or base layer if one is present. In a preferred embodiment, the porous image-receiving layer comprises at least about 90–95% by weight of particles.

In general, any binder may be used in the invention. In a preferred embodiment, the binder is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly (acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is poly(vinyl alcohol). The polymeric binder should be chosen so that it is compatible with the aforementioned particles.

The amount of binder used in the invention should be sufficient to impart cohesive strength to the ink jet recording element, but should also be minimized so that the interconnected pore structure formed by the particles is not filled in by the binder. In a preferred embodiment of the invention, the amount of binder employed is less than bout 10% by weight, preferably about 5–10% by weight.

The thickness of the image-receiving layer may range from about 5 to about 40 μm, preferably from about 10 to about 20 μm. The coating thickness required is determined through the need for the coating to act as a sump for absorption of ink solvent and the need to hold the ink near the coating surface. The coating may be applied in a single layer or in multiple layers so the functionality of each coating layer may be specified. For example, a two-layer structure can be created wherein the base layer functions as a sump for absorption of ink solvent while the top layer holds the ink. In that case, the nonionic surfactant and particles are used in both layers, i.e., the base layer contains at least about 90% by weight of particles and less than about 10% by weight of a binder, and the base layer also contains a nonionic surfactant having an HLB number of less than about 10 in an amount to substantially prevent foaming of the coating composition which is used to coat the support with the base layer.

After coating, the ink jet recording element may be subject to calendering or supercalendering to enhance surface smoothness. In a preferred embodiment of the invention, the ink jet recording element is subject to hot, soft-nip calendering at a temperature of about 65° C. and pressure of 14000 kg/m at a speed of from about 0.15 m/s to about 0.3 m/s.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalytel® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965, 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 μm, preferably from about 75 to 300 μm. Antioxidants, antistatic agents, plasticizers and other known additives may be incorporated into the support, if desired.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published Dec. 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include adhesion promoters, rheology modifiers, biocides, lubricants, dyes, optical brighteners, matte agents, antistatic agents, etc.

The coating composition can be coated so that the total solids content will yield a useful coating thickness, and for particulate coating formulations, solids contents from 10–60% are typical.

Ink jet inks which can be used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Example 1

Surfactant in Image-receiving Layer Coating Solution

Coating solution 1 was prepared by mixing 100 dry g of Dispal® 14N4–80 alumina (Condea Vista Co.) as a 20% solution with 4 dry g of poly(vinyl alcohol) GH-17® (Nippon Gohsei Co. Ltd.) as a 10% solution and 0.1 dry g of 2,3-dihydroxy-1,4-dioxane (Clariant Corp). The solids of the coating solution was adjusted to 20% by adding water.

The nonionic surfactants S-1 through S-10 described above were compared to the performance of control surfactants C-1 through C-4, identified below, whose HLB numbers are outside the range of this invention. All suifactants were added to the coating solution at a level of 0.5% by weight.

C-1 Silwet® L7500 (Witco Corp.)

C-2 Pluronic® F108 (BASF Corp.)

C-3 Tetronic® 904 (BASF Corp.)

C-4 Triton® X-45 (Union Carbide Corp.)

The HLB numbers of all surfactants employed are based on the values reported by the respective manufacturer, except where noted.

About 20 ml of the coating solution was placed in a 50 ml graduated cylinder which had a diameter of 1 cm. It was then manually shaken until the foam height remained constant. After the shaking was stopped, the initial foam volume (total volume of the coating solution and associated foam) was noted. The volume of the foam was noted again after 30 minutes.

If the foam height had reduced to about 20 ml, the surfactant is deemed effective. If the foam height remained high even after 30 minutes, the surfactant is considered to be ineffective. The results are shown in Table 1 below.

TABLE 1

| Surfactant | HLB | Initial foam volume | Volume after 30 minutes | Effectiveness |
|---|---|---|---|---|
| None | N/A | 41 | 40 | N/A |
| S-1 | 5-8 | 23 | 21 | Yes |
| S-2 | 5-8 | 23 | 21 | Yes |
| S-3 | 5-8 | 24 | 20 | Yes |
| S-4 | 3 | 20 | 20 | Yes |
| S-5 | 7 | 25 | 21 | Yes |
| S-6 | 3 | 25 | 20 | Yes |
| S-7 | 1 | 26 | 21 | Yes |
| S-8 | 2.8* | 22 | 21 | Yes |
| S-9 | 9.7 | 27 | 21 | Yes |
| S-10 | 4.9 | 21 | 21 | Yes |
| C-1 | 13 | 37 | 37 | No |
| C-2 | 27 | 46 | 46 | No |
| C-3 | 15 | 40 | 38 | No |
| C-4 | 10.4 | 44 | 40 | No |

*calculated

The above results show that the non-ionic surfactants of the invention were effective in reducing foam as compared to the surfactants whose HLB number is above the number described in the invention

Example 2

Surfactant in Base Layer Coating Solution

Coating solution 2 was prepared by mixing 100 dry g of Albagloss-s® precipitated calcium carbonate (Speciality Minerals Inc.) as a 70% solution with 5 dry g of poly(vinyl alcohol) GH-17® (Nippon Gohsei Co., Ltd.) as a 10% solution and 0.1 dry g of 2,3-dihydroxy-1,4-dioxane (Clariant Corp). The solids of the coating solution was adjusted to 35% by adding water.

The same surfactants were added to the base coating composition and tested as in Example 1 and the results are shown in Table 2 below:

TABLE 2

| Surfactant | HLB | Initial foam volume | Volume after 30 minutes | Effectiveness |
|---|---|---|---|---|
| None | N/A | 36 | 36 | N/A |
| S-1 | 5-8 | 26 | 21 | Yes |
| S-2 | 5-8 | 25 | 23 | Yes |
| S-3 | 5-8 | 28 | 26 | Yes |
| S-4 | 3 | 29 | 26 | Yes |

TABLE 2-continued

| Surfactant | HLB | Initial foam volume | Volume after 30 minutes | Effectiveness |
|---|---|---|---|---|
| S-5 | 7 | 25 | 21 | Yes |
| S-6 | 3 | 32 | 25 | Yes |
| S-7 | 1 | 27 | 22 | Yes |
| S-8 | 2.8* | 30 | 26 | Yes |
| S-9 | 9.7 | 27 | 21 | Yes |
| S-10 | 4.9 | 21 | 21 | Yes |
| C-1 | 13 | 39 | 37 | No |
| C-2 | 27 | 43 | 46 | No |
| C-3 | 15 | 42 | 38 | No |
| C-4 | 10.4 | 43 | 40 | No |

*calculated

The above results show that the non-ionic surfactants of the invention were effective in reducing foam as compared to the surfactants whose HLB number is above the number described in the invention Example 3

Printing on Recording Element

The base layer coating solution from Example 2 was bead-coated at 25° C. on a base paper and dried at 60° C. by forced air. The base paper used was Nekoosa Solutions Smooth® (Georgia Pacific), Grade 5128 (Carrara White®, Color 9220), basis weight 150 g/m$^2$. The image-receiving layer coating solution of Example 1 was coated on top of this base layer. The recording element was then dried at 60° C. by forced air to yield a two-layer recording element in which the thicknesses of the bottom and topmost layers were 25 $\mu$m (27 g/m$^2$) and 8 $\mu$m (8.6 g/m$^2$), respectively.

Test images of cyan, magenta, yellow, red, green and blue patches at 100% ink laydown were printed on the above recording element using an Epson Stylus® Color 740 using inks with catalogue number S020191. Immediately after ejection from the printer, a piece of bond paper was placed over the printed image and rolled with a smooth, heavy weight. Then the bond paper was separated from the printed image. Ink transferred to the bond paper if the recording element was not dry. The length of the transferred image on the bond paper was measured and is proportional to the dry time. Dry times corresponding to a length of about 40 cm or less are acceptable.

After drying for 24 hours at ambient temperature and humidity, the Status A D-max densities were measured using an X-Rite® 820 densitometer as follows (for each of the red, green and blue densities, the two component color densities were measured and averaged). The results are shown in table 3.

TABLE 3

| Dry Time | Status A D-max Density | | | | | |
|---|---|---|---|---|---|---|
| (cm) | Cyan | Magenta | Yellow | Red | Green | Blue |
| 0 | 2.28 | 1.99 | 1.79 | 1.96 | 2.13 | 2.31 |

The above results show that the ink jet recording element of the invention has good image optical density and an apparent instant dry time (No ink was transferred to the bond paper immediately after printing).

The invention has been described in detail with particular reference to certain preferred embodiments thereof, but it will be understood that variations and modifications can be effected within the spirit and scope of the invention.

What is claimed is:

1. An ink jet recording element comprising a support having thereon a porous image-receiving layer comprising at least 90% by weight of particles and less than 10% by weight of a binder, said image-receiving layer also containing a nonionic surfactant having an HLB number of less than 10 in an amount to substantially prevent foaming of the coating composition which is used to coat said support with said image-receiving layer.

2. The recording element of claim 1 wherein said nonionic surfactant is present in an amount of at least 0.05% by weight.

3. The recording element of claim 1 wherein said nonionic surfactant is present in an amount of from about 0.05% to about 1.0% by weight.

4. The recording element of claim 1 wherein said surfactant is an ethoxylated alcohol, a polypropylene oxide-polyethylene oxide block copolymer or an alkoxylated poly (dimethyl siloxane).

5. The recording element of claim 1 wherein said particles are inorganic.

6. The recording element of claim 5 wherein said inorganic particles comprise alumina, silica, fumed alumina or fumed silica.

7. The recording element of claim 1 wherein said binder is a hydrophilic binder.

8. The recording element of claim 7 wherein said hydrophilic binder is poly(vinyl alcohol).

9. The recording element of claim 1 wherein a base layer is present between said support and said image-receiving layer.

10. The recording element of claim 9 wherein said base layer contains at least 90% by weight of particles and less than 10% by weight of a binder, said base layer also containing a nonionic surfactant having an HLB number of less than about 10 in an amount to substantially prevent foaming of the coating composition which is used to coat said support with said base layer.

11. The recording element of claim 10 wherein said nonionic surfactant is present in an amount of at least 0.05% by weight.

12. The recording element of claim 10 wherein said nonionic surfactant is present in an amount of from about 0.05% to about 1.0% by weight.

13. The recording element of claim 10 wherein said surfactant is an ethoxylated alcohol, a polypropylene oxide-polyethylene oxide block copolymer or an alkoxylated poly (dimethyl siloxane).

14. The recording element of claim 10 wherein said particles are inorganic.

15. The recording element of claim 14 wherein said inorganic particles comprise calcium carbonate, clay or titanium dioxide.

16. The recording element of claim 10 wherein said binder is a hydrophilic binder.

17. The recording element of claim 16 wherein said hydrophilic binder is poly(vinyl alcohol).

* * * * *